United States Patent [19]

Jorgensen

[11] 4,117,192

[45] Sep. 26, 1978

[54] DEFORMABLE RETROREFLECTIVE PAVEMENT-MARKING SHEET MATERIAL

[75] Inventor: Jens L. Jorgensen, Anoka, Minn.

[73] Assignee: Minnesota Mining and Manufacturing Company, Saint Paul, Minn.

[21] Appl. No.: 825,691

[22] Filed: Aug. 18, 1977

Related U.S. Application Data

[63] Continuation of Ser. No. 658,283, Feb. 17, 1976, abandoned.

[51] Int. Cl.[2] ..... B32B 5/16

[52] U.S. Cl. ..... 428/337; 350/105; 427/137; 427/163; 428/325; 428/338; 404/93; 404/94

[58] Field of Search ..... 427/137, 163; 428/323, 428/325, 337, 336, 338, 341; 350/105; 404/93, 94

[56] References Cited

U.S. PATENT DOCUMENTS

| | | | |
|---|---|---|---|
| 2,440,584 | 4/1948 | Heltzer et al. | 427/137 X |
| 3,030,870 | 4/1962 | Gild | 427/137 X |
| 3,043,196 | 7/1962 | Palmquist et al. | 350/105 |
| 3,222,204 | 12/1965 | Weber et al. | 427/163 |
| 3,556,637 | 1/1971 | Palmquist | 350/105 |
| 3,587,415 | 6/1971 | Eigenmann | 404/94 |
| 3,764,455 | 10/1973 | Lovell et al. | 428/325 |
| 3,915,771 | 10/1975 | Gatzke et al. | 404/94 X |
| 3,935,365 | 1/1976 | Eigenmann | 428/323 |

*Primary Examiner*—Thomas J. Herbert, Jr.
*Attorney, Agent, or Firm*—Cruzan Alexander; Donald M. Sell; Roger R. Tamte

[57] ABSTRACT

Pavement-marking sheet material made from deformable, reduced-elasticity polymeric materials are made retroreflective by adhering to the sheet material a thin support film having retroreflective elements partially embedded in it.

6 Claims, 1 Drawing Figure

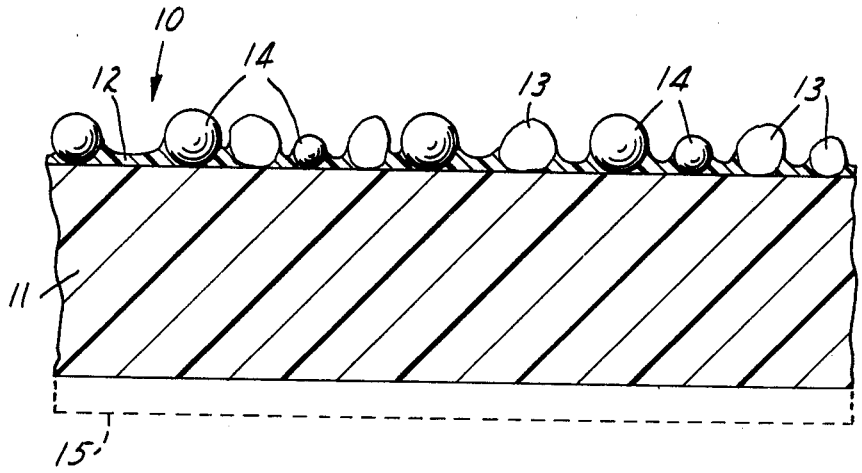
10
12
14
13
14
13
11
15

DEFORMABLE RETROREFLECTIVE PAVEMENT-MARKING SHEET MATERIAL

REFERENCE TO RELATED APPLICATION

This application is a continuation of application Ser. No. 658,283, filed Feb. 17, 1976 now abandoned.

BACKGROUND OF THE INVENTION

Pavement-marking sheet material made from unvulcanized elastomer precursors provide traffic control markings of superior durability because of their deformability and reduced elasticity. Such sheet material deforms readily into intimate contact with the irregular pavement surface; it absorbs the energy of wheel impacts without fracture; and its low elasticity avoids the stretch-return action that has been found to loosen sheet material from a roadway.

A deficiency of such deformable marking materials is that they have been unavailable in satisfactory retroreflective forms, apparently because their deformability prevents traditional ways of providing retroreflectivity. Conventional pavement markings include a firm supporting structure, such as a metal foil or a dried polymeric paint matrix, on which retroreflective microspheres may be supported. The deformable pavement-marking sheet materials or tapes do not provide such a support, with the result that microspheres applied to the top surface of such markings become embedded into the tapes under the pressure of road traffic.

One prior-art teaching (Eigenmann, U.S. Pat. No. 3,587,415) seeks to avoid this deficiency in deformable pavement-marking tapes by making such a tape in two levels, one level comprising a continuous base strip adhered to a roadway, and the second level comprising cross-strips adhered to the top of the base strip and filled with microspheres, desirably in an amount of about 80 weight-percent. Microspheres contained in the cross-strips are said to be exposed at the vertical edges of the strips to provide reflection of light from the headlamps of vehicles traveling on the roadway. Whether or not useful retroreflectivity would be provided by the apparently minimally exposed microspheres, the construction is clearly not a fully effective answer to the need for a retroreflective deformable pavement-marking tape: such a two-level tape is expensive to manufacture; the base strip remains deformable, such that the cross-strips can be pressed into it; and vertical edges as described typically become covered by collected dirt.

It has also been contemplated that deformable pavement-marking sheet materials be reflectorized by use of very large retroreflective elements having diameters larger than the thickness of the pavement-marking sheet material. However, serious consideration of such an approach has been prevented by the practical unavailability of retroreflective elements having the needed strength, size, and optical properties for such a use.

Others have sought to reflectorize deformable sheet materials by use of stiffer, less deformable tape formulations, but these constructions sacrifice the superior durability provided by reduced elasticity and deformability.

In short, none of the prior-art suggestions has resulted in a deformable pavement-marking sheet material that exhibits desired durability, reflectivity, and moderate cost. Until there is such a sheet material, the full potential of deformable pavement-marking sheet materials for traffic control purposes will not be realized.

SUMMARY OF THE INVENTION

Briefly, a new pavement-marking sheet material of the invention comprises a base sheet exhibiting the desired deformation properties; a thin support film that is less thick but more elastic than the base sheet adhered to one surface of the base sheet; and a scattering of transparent microspheres partially embedded in the support film and partially exposed out of the support film.

Several surprising effects are exhibited by this combination. For example, despite the deformable nature of the base sheet underlying the support film (the base sheet is deformable enough so that microspheres pressed against the base sheet under the pressure of wheeled road traffic will become fully embedded in the base sheet), and despite the very thin nature of the support film, such that the support film does not override the desired deformation properties of the base sheet that account for superior durability, but typically ruptures upon extensive deformation—i.e. 50–200 percent—of the sheet material, the support film nevertheless supports the microspheres at the top of the sheet material. Even under the heavy pounding of road traffic, the microspheres do not break through the support film, but remain supported at the top surface of the sheet material.

Further, despite the dissimilarity of the base sheet and support film, the stress of road traffic does not cause separation of the two. This adhesion is further surprising in constructions in which the support film is a vinyl film plasticized with plasticizers that might be expected to migrate out of the vinyl film to the juncture of support film and base sheet.

The sum effect of these features is that sheet material of the invention, with its unconventional use of a thin support film over a polymeric matrix that would normally be regarded as the appropriate binder for retroreflective elements, achieves an important advance in the art of deformable pavement-marking sheet materials.

DETAILED DESCRIPTION

The Fig. of the sheet material of the invention 10 shown in the enlarged partial section view in the drawing includes a base sheet 11, a support film 12 adhered to one surface of the base sheet, and particulate material partially embedded in the support film 12 and partially exposed above the support film. In the illustrated embodiment the particulate material includes irregularly shaped skid-resisting particles 13 as well as transparent microspheres 14, which serve as retroreflective elements. Adhesives are generally used to adhere the sheet material to a roadway, and a layer 15 of pressure-sensitive or other adhesive may be included in sheet material of the invention for that purpose; alternatively adhesives may be applied to a roadway at the site of application.

The base sheet 11 typically comprises elastomer precursors, i.e. ingredients that may be vulcanized or cured to form an elastomer. Particularly useful materials are acrylonitrile-butadiene polymers, millable urethane polymers, and neoprenes, which are not vulcanized in the sheet material and therefore permit the sheet material to exhibit desired deformation properties. Such deformation properties are further promoted by the inclusion of extender resins such as chlorinated paraffins, hydrocarbon resins or polystyrenes. The elastomer-precursor ingredients preferably account for at least 50 weight-percent of the polymeric ingredients in the base sheet.

Particulate fillers are also included in the base sheet, typically in large amount, to lower cost and provide modified properties. The base sheet may also include microspheres, skid-resisting particles, pigments, and other additives. Generally the base sheet is at least about one-fourth millimeter thick, and preferably at least about one millimeter thick, but generally is less than about 2 or 3 millimeters thick.

The support film adhered to the base sheet is more elastic than the base sheet, meaning that upon application and then release of deforming stress, it will return more closely to its original shape. The result is that when microspheres are pressed at normal room temperature into a sample of support film laid on a hard unyielding surface with a pressure that would embed microspheres into the base sheet, the microspheres do not become embedded but remain on the surface of the support film after the pressure has been released. In addition, the support film has good adhesion to retroreflective elements or other particulate matter to be embedded in it, which assists in holding such particles against penetration into the base sheet. Vinyl-based polymers (i.e., polymers that include at least 50 weight-percent vinyl monomers) are especially useful materials because of their toughness, abrasion resistance, and durability in a highway environment, but other useful polymers include polyurethanes, epoxies, and polyesters. Support films based on vinyl polymers are typically plasticized to provide desired flexibility. The support film is also typically pigmented to provide color to the sheet material, and the base sheet is typically pigmented the same color to provide continuity of color after the support film has eventually been removed by traffic abrasion.

Because the deformable characteristics of presently preferred base sheet materials makes it difficult to coat them in conventional coating and oven-drying apparatus, the support film is desirably formed on a separate carrier film and then adhered to the base sheet, e.g. by removing the support film from the carrier film, and passing it and the deformable base sheet together through pressure rollers. A thin layer of adhesive may be coated on the support film or base sheet, or the base sheet may be wiped with solvent, to promote adhesion. The microspheres and any other particulate additive are typically partially embedded in the film during its formation, e.g. by cascading them onto the carrier web after a solution of the support film ingredients has been coated on the carrier web and partially dried. However, in less preferred embodiments the microspheres may be adhered to the support film with a coating of adhesive or binder material.

The support film is thin enough so that a pavement-marking sheet material of the invention can still permanently deform and conform to a pavement surface. Generally this means that the support film is less thick than the base sheet; preferably it is less thick than the average diameter, and more preferably less thick than the average radius, of the microspheres that are embedded in it. An important requirement is that the support film be thick enough to provide a desired contact with the partially embedded microspheres. A film having a wet thickness on the order of the average radius of the retroreflective elements and other particulate material is generally satisfactory, and will hold the microspheres against puncture through the support film into the deformable base sheet. While the support film will often dry to a thickness less than the radius of the average retroreflective element, as shown in the drawing, the support film will wet the sides of the retroreflective elements and thus obtain the desired good adhesion.

Glass microspheres are the most common retroreflective element used in a pavement-marking sheet material, because they are widely available and perform adequately. Other retroreflective elements, such as the aggregate of transparent microspheres described in Palmquist et al., U.S. Pat. No. 3,043,196 and Palmquist, U.S. Pat. No. 3,556,637, may also be used for specialized purposes. The microspheres may be treated with fluorocarbon treatments such as described in Weber et al, U.S. Pat. No. 3,222,204, whereupon they typically become wetted by the polymeric material of the support film to about one half their diameter. Other treatments, such as silane treatments, may also be applied to the microspheres, to improve adhesion, to control wetting of the microspheres, etc.

The retroreflective elements are desirably applied in a scattered manner over the surface of the support film. Dirt tends to accumulate around the base of particles protruding from a pavement-marking applied to a roadway, so that a dense monolayer of microspheres will cause the marking to become more dirty. The particulate material partially embedded in the support film desirably occupies 50 percent or less of the area of the support film. While larger microspheres provide greater retroreflection, it is generally most practical to use microspheres that are no more than about 1500 micrometers, and preferably no more than 1000 micrometers, in average diameter. To obtain desired reflection, the microspheres are generally at least 100 micrometers in average diameter and more preferably are greater than 150 micrometers in average diameter. Other retroreflective elements generally fall within this range of sizes also.

The microspheres may have different indices of refraction depending on the results desired. For the best retroreflection, microspheres having an index of refraction of about 1.9 will be used. However, microspheres having an index of refraction of 1.5 are cheaper and stronger and may be more commonly used.

The best non-skid properties are achieved in pavement-marking sheet material of the invention by partially embedding irregularly shaped particles in the support film. Preferred sheet materials or tapes of the invention include such a particulate material, typically sand. In these preferred sheet materials, the skid-resistant particles generally account for about 30-70 weight-percent of the particulate materials partially embedded in the surface of the support film.

The invention will be further illustrated by the following example. A mixture of the following ingredients was compounded and calendered into a sheet of about 1.2 millimeters thickness.

| | Parts by Weight |
|---|---|
| Acrylonitrile-butadiene elastomer precursor ("Hycar 1022" available from B.F. Goodrich | 23 |
| Chlorinated paraffin (A mixture of "Chlorowax 70-S" and "Chlorowax 40" available from Diamond Shamrock in a weight ratio of 7.8 to 2.2) | 19.6 |
| Asbestos RG 144 available from Union Carbide | 27.6 |
| Titanium dioxide ("TiPure R960" available from duPont) | 29.9 |
| Synthetic silica ("Hi Sil 233" available from PPG Industries) | 4.6 |
| Stearic acid | 0.8 |

-continued

| | Parts by Weight |
|---|---|
| Glass microspheres averaging 350 micrometers in diameter | 64.5 |

A support film was then prepared by coating onto a silicone-treated paper release liner a solution of the ingredients listed below in an amount sufficient to provide a dry thickness of 75 micrometers.

| | Parts by Weight |
|---|---|
| Two copolymers of vinyl chloride and vinyl acetate (comprising about 87 weight-percent vinyl chloride and 13 weight-percent vinyl acetate; made by Union Carbide) "Vinylite" VMCH | 11 |
| "Vinylite" VYHH | 11 |
| Liquid organo-tin-sulfur stabilizer (Advastab TM-180 from Carlisle Chemical Works) | 0.6 |
| Pigment Paste | 23.1 |
| Xylene | 15.5 |
| Methyl isobutyl ketone | 3.9 |
| Isophorone | 3.9 |
| Methyl ethyl ketone | 31 |

The pigment paste included in the above formulation is prepared by mixing the following ingredients:

| | Parts by Weight |
|---|---|
| Lead Chromate | 57.0 |
| Dioctyl phthalate | 9.5 |
| Linear polyester plasticizer made from long-chain polybasic acid and polyhydric alcohol including glycerol and ethylene glycol ("Paraplex G40" from Rohm and Haas) | 28.5 |
| Xylene | 5.0 |

After partial evaporation of solvent, a one-to-one mixture by weight of glass microspheres averaging 350 micrometers in diameter and silica (sand) particles ranging between 150 and 600 micrometers in diameter were cascaded onto the coated web in an amount of about 0.35 kg/sq. meter of the web. The coated web was then dried by heating it in an oven.

The release liner was then stripped away, and after the base sheet described above had been wetted with methyl ethyl ketone, the support film and base sheet were laminated together by passing them through pressure rolls.

What is claimed is:

1. Pavement-marking sheet material comprising a base film that is about one-fourth millimeter or more thick, includes a polymer, an extender resin, and particulate fillers, and exhibits deformability and reduced elasticity such that if retroreflective elements were pressed directly against the base film under the pressure of wheeled road traffic, they would become fully embedded in the base film; a thin support film adhered to one surface of the base film; and a scattering of glass microspheres arranged in a monolayer partially embedded and strongly adhered in the support film and partially exposed out of the support film, said support film being less thick than the average radius of said glass microspheres, and being less thick but more elastic than the base film, whereby the support film with said glass microspheres resists embedment into said base film during passage of wheeled road traffic over the sheet material and returns closely to its original shape after the road traffic has completed its passage over the sheet material.

2. Sheet material of claim 1 in which said base film comprises unvulcanized elastomer precursor.

3. Sheet material of claim 1 in which said support film comprises a vinyl-based polymer.

4. Sheet material of claim 1 which further includes irregular skid-resisting particles partially embedded in, and partially exposed out of the support film.

5. Pavement-marking sheet material comprising a base film that is about one millimeter or more thick, includes unvulcanized elastomer precursor, extender resins, and particulate fillers, and exhibits deformability and reduced elasticity such that if microspheres were pressed directly against the base film under the pressure of wheeled road traffic, they would become embedded in the base film; a thin support film adhered to one surface of the base film; and a scattering of transparent microspheres arranged in a monolayer partially embedded and strongly adhered in the support film and partially exposed out of the support film, said support film being less thick than the base film and less thick than the average radius of the microspheres and more elastic than the base film; whereby said support film with said microspheres resists embedment into said base film during passage of wheeled road traffic over the sheet material and returns closely to its original shape after the road traffic has completed its passage over the sheet material.

6. Pavement-marking sheet material of claim 5 that further includes irregular skid-resisting particles partially embedded in the support film.

* * * * *